US010820113B2

(12) United States Patent
Song

(10) Patent No.: US 10,820,113 B2
(45) Date of Patent: Oct. 27, 2020

(54) SPEAKER

(71) Applicant: AAC Technologies Pte. Ltd., Singapore (SG)

(72) Inventor: Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,576

(22) Filed: Jul. 30, 2019

(65) Prior Publication Data

US 2020/0045465 A1 Feb. 6, 2020

(30) Foreign Application Priority Data

Aug. 4, 2018 (CN) ..... 2018 1 0881123

(51) Int. Cl.

| | |
|---|---|
| ***H04R 9/06*** | (2006.01) |
| ***H04R 9/02*** | (2006.01) |
| ***H01F 7/126*** | (2006.01) |
| ***H01F 7/08*** | (2006.01) |

(52) U.S. Cl.

CPC ..... *H04R 9/06* (2013.01); *H01F 7/081* (2013.01); *H01F 7/126* (2013.01); *H04R 9/025* (2013.01)

(58) Field of Classification Search

CPC . H04R 9/06; H04R 9/025; H04R 7/18; H04R 7/127; H04R 2307/025; H04R 2307/027; H01F 7/081; H01F 7/126

USPC ..... 381/398, 400

See application file for complete search history.

(56) References Cited

U.S. PATENT DOCUMENTS

| | | | | |
|---|---|---|---|---|
| 5,181,253 | A * | 1/1993 | Jordan | H04R 1/24 381/182 |
| 2004/0188174 | A1* | 9/2004 | Sahyoun | H04R 9/045 181/157 |
| 2004/0188175 | A1* | 9/2004 | Sahyoun | H04R 9/041 181/157 |
| 2011/0274308 | A1* | 11/2011 | Doh | H04R 9/06 381/398 |
| 2015/0117699 | A1* | 4/2015 | Cai | H04R 9/025 381/412 |
| 2018/0367885 | A1* | 12/2018 | Gong | H04R 9/025 |

FOREIGN PATENT DOCUMENTS

| | | | | |
|---|---|---|---|---|
| EP | 2811760 | A1 * | 12/2014 | H04R 9/06 |

* cited by examiner

*Primary Examiner* — Sean H Nguyen
(74) *Attorney, Agent, or Firm* — W&G Law Group LLP

(57) ABSTRACT

The speaker provided by the present invention includes a magnetic circuit system. The magnetic circuit system includes an upper magnetic conductive plate, and a lower magnetic conductive plate. The magnet includes a first magnet mounted on a center of the lower magnetic conductive plate and facing the diaphragm, and a second magnet mounted on the lower magnetic conductive plate and surrounding the first magnet. The upper magnetic conductive plate includes a first horizontal portion engaging with the second magnet, and a first oblique portion extending obliquely from the first horizontal portion. The speaker further includes a suspension sandwiched between the upper magnetic conductive plate and the second magnet for improving the stability of the vibration of the diaphragm and the balance of the vibration, and thus improves the power of speaker.

8 Claims, 5 Drawing Sheets

A-A

A-A

SPEAKER

FIELD OF THE PRESENT DISCLOSURE

The present disclosure relates to the field of electromagnetic transducers, more particularly to a speaker used in a portable electronic device.

DESCRIPTION OF RELATED ART

A speaker is a very important component equipped in a mobile phone for producing audible sounds. A speaker generally uses a diaphragm to produce vibration and further to generate sounds.

In order to adapt to miniaturization and multifunctional development of various audio equipment and information communication equipment, the speaker used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. The coil is fixedly supported by only the vibrating diaphragm, and when the vibrating system vibrates, unbalanced vibration is easily generated. The power is required to be reduced to meet the balance of the vibration system, and therefore the power of the vibration system is limited. So that the acoustic performance of the speaker using the vibration system is limited. Therefore, an improved speaker is desired.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby are only to explain the disclosure, not intended to limit the disclosure.

Figure 1:
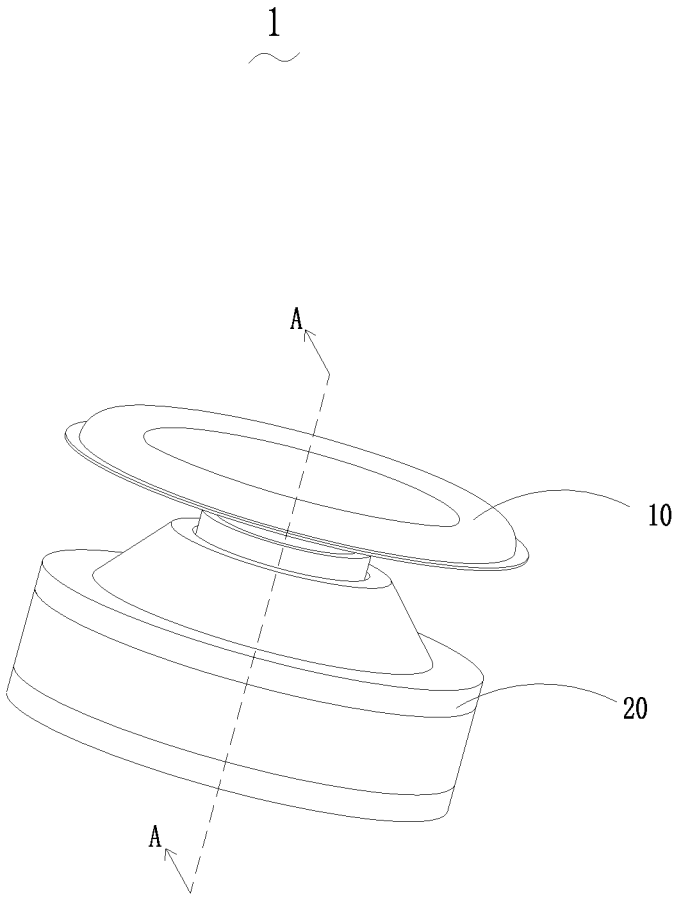
FIG. 1 is an isometric view of a speaker in accordance with a first exemplary embodiment of the present disclosure.
Figure 2:
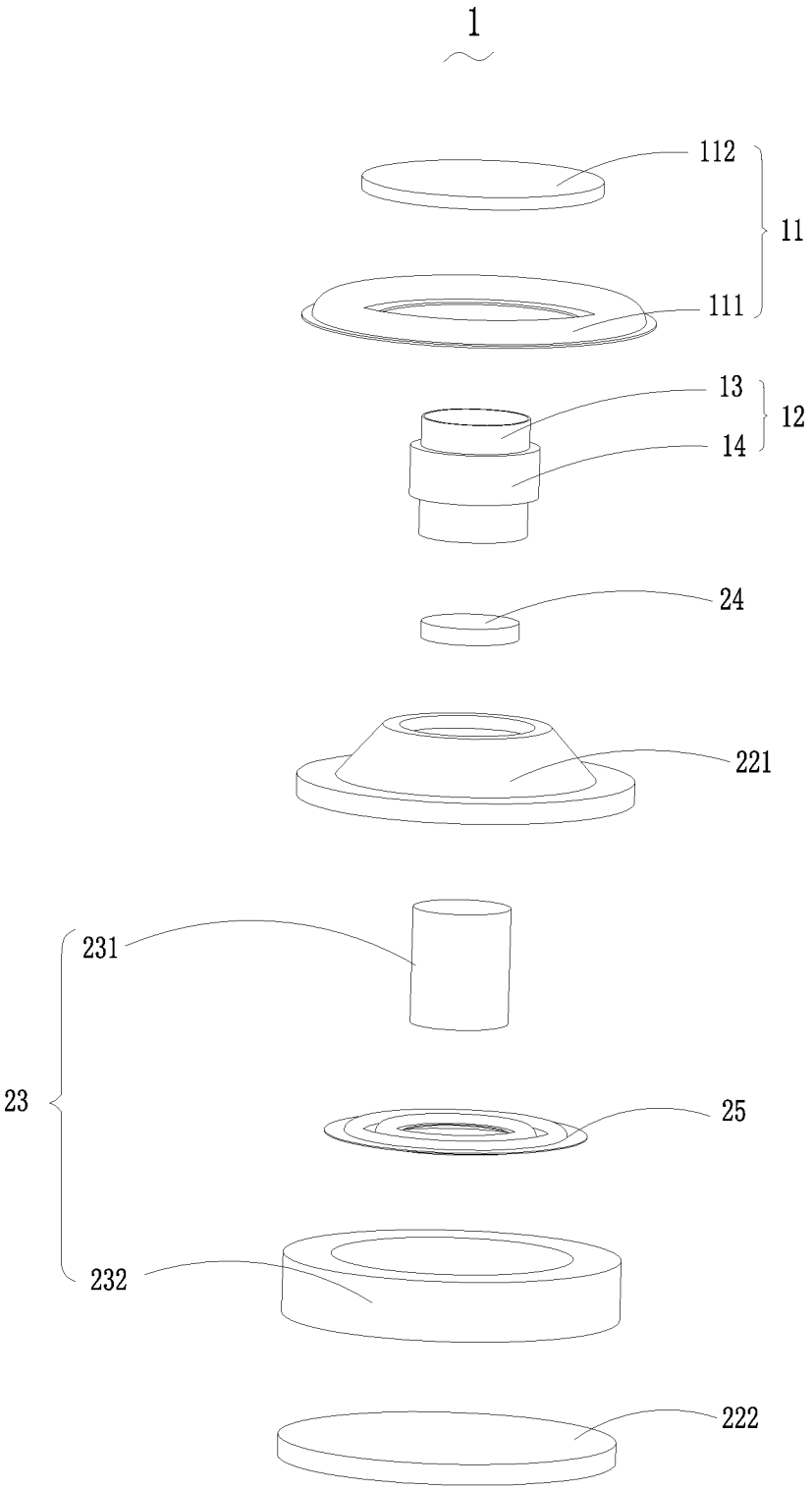
FIG. 2 is exploded view of the speaker in FIG. 1.

Referring to FIGS. 1-2, a speaker 1, in accordance with an exemplary embodiment of the present disclosure, includes a vibration system 10 and a magnetic circuit system 20 for interacting with the vibration system 10 to produce sounds.

Embodiment 1

The vibration system 10 includes a diaphragm 11 and a coil assembly 12 for driving the diaphragm 11 to vibrate along a vibration direction. The vibration of the diaphragm 11 generates sounds.

In the embodiment, the coil assembly 12 includes a coil frame 13 connecting to the diaphragm 11 and a coil wire 14 wound around the coil frame 13 for driving the diaphragm 11. The coil frame 13 is a cylinder with a hollow space. The diaphragm 11 includes a rim 111 and a dome 112 assembled with the rim 111. The rim 111 and the dome 112 are formed separately and then assembled with each other. Alternatively, the dome 112 and the rim 111 can be integrally formed as a whole.

The magnetic circuit system 20 includes a magnetic conductive assembly 22 with a receiving space 21, a magnet 23 accommodated in the receiving space 21, a magnetic gap formed between the magnetic conductive assembly 22 and the magnet 23. The coil assembly 12 is partially inserted into the magnetic gap. When electrified, the coil assembly 12 will be activated to vibrate by the magnetic field produced by the magnetic circuit system 20. Accordingly, the diaphragm 11 is forced to vibrate due to the movement of the coil assembly 12.

Figure 3:
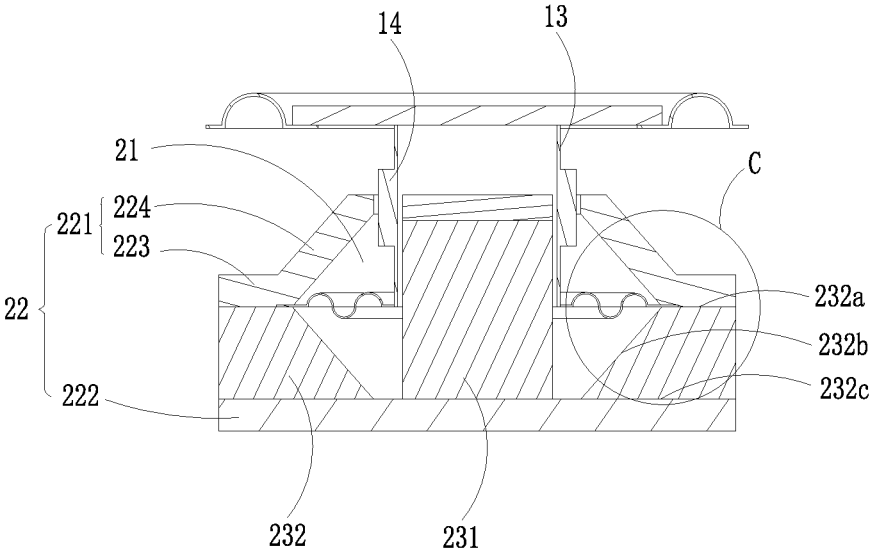
FIG. 3 is a cross-sectional view of the speaker in FIG. 1, taken along line A-A.

Referring to FIG. 3, the magnetic conductive assembly 22 includes an upper magnetic conductive plate 221 adjacent to the diaphragm 11, and a lower magnetic conductive plate 222 far away from the diaphragm 11. The magnet 23 includes a first magnet 231 mounted on a center of the lower magnetic conductive plate 222 and facing the diaphragm 11, and a second magnet 232 mounted on the lower magnetic conductive plate 222 and surrounding the first magnet 231. The second magnet 232 keeps a distance from the first magnet 231 for forming the magnetic gap therebetween. Along a direction perpendicular to the vibration direction, a projection of the second magnet 232 locates fully on the first magnet 231. The upper magnetic conductive plate 221, the lower magnetic conductive plate 222 and the magnet 23 cooperatively form the receiving space 21. The upper magnetic conductive plate 221 includes a first horizontal portion 223 engaging with the second magnet 232, and a first oblique portion 224 extending obliquely from an inner edge of the first horizontal portion 223 toward the diaphragm 11 and at the same time toward the coil assembly 12. A projection of the first oblique portion 224 along the direction perpendicular to the vibration direction locates at least partially on the coil wire 14. The coil frame 13 surrounds at least part of the first magnet 231. The second magnet 232 includes a first end surface 232*a* adjacent to the first horizontal portion 223, a second end surface 232*c* adjacent to the lower magnetic conductive plate 222, and an inner surface 232*b* adjacent to the first magnet 231 for connecting the first end surface 232*a* to the second end surface 232*c*. The inner surface 232*b* extends from an inner edge of the first end surface 232*a* toward the lower magnetic conductive plate 222 and at the same time toward the first magnet 232. The first end surface 232*a* connects to the first horizontal portion 223. The magnetic circuit system 20 further includes a pole plate 24 attached to the first magnet, and the pole plate 24 has a projection long the direction perpendicular to the vibration direction locates at least partially on the first oblique portion 224.

Figure 4:
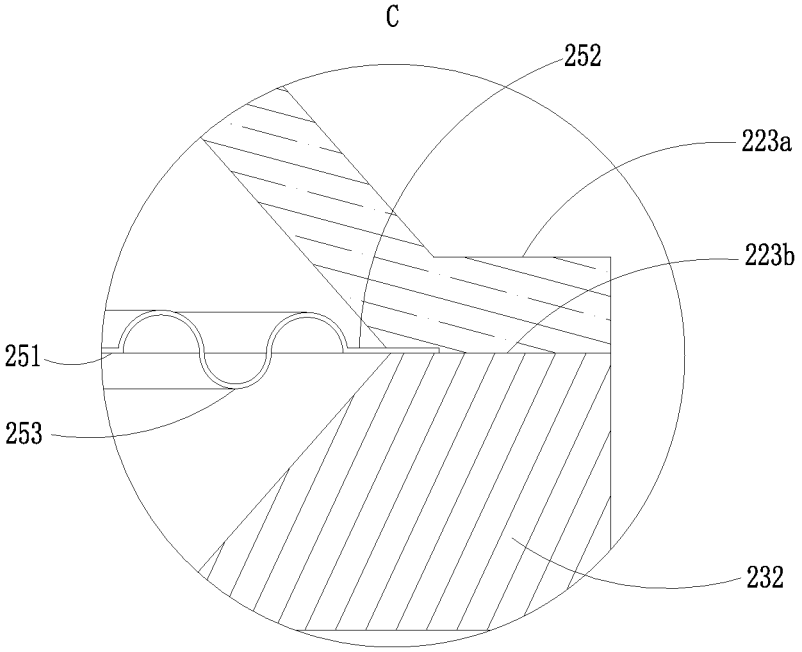
FIG. 4 is an enlarged view of Part C in FIG. 3.

Referring to FIGS. 3-4, the speaker further includes a suspension 25 locates in the receiving space 21 for supporting the coil assembly 12. The suspension 25 includes a first fastening portion 251, a second fastening portion 252, and a connecting portion 253 connecting between the first and second fastening portions 252, 252. The first fastening portion 251 connects to the coil assembly 12 at an end away from the diaphragm 11, and the second fastening portion 252 is sandwiched between the first horizontal portion 223 and the second magnet 232. The first fastening portion 252 of the suspension 25 extends to the second fastening portion 252 along a waved path. Alternatively, the first fastening portion 251 may extend to the second fastening portion 252 along a straight line, or along an arc.

Figure 5:
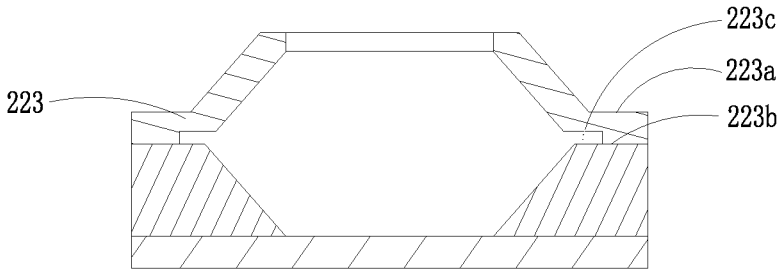
FIG. 5 is a cross-sectional view of a magnetic conductive assembly, and a second magnet of the speaker of the first embodiment.

The first horizontal portion 223 includes a first lower surface 223*b* adjacent to the first end surface 232*a*, and a first upper surface 223*a*. Referring to FIG. 5, the first horizontal portion 223 includes a first fastening slot 223*c* recessed from the first lower surface 223*b* toward the first upper surface 223*a*. The suspension 25 is fixed by the fastening slot 223*c*, sue to which, the suspension 25 is fixed stably, and it is not easy to break the connection between the suspension and the magnetic circuit system, and the vibration of the diaphragm is balanced.

Embodiment 2

Figure 6:
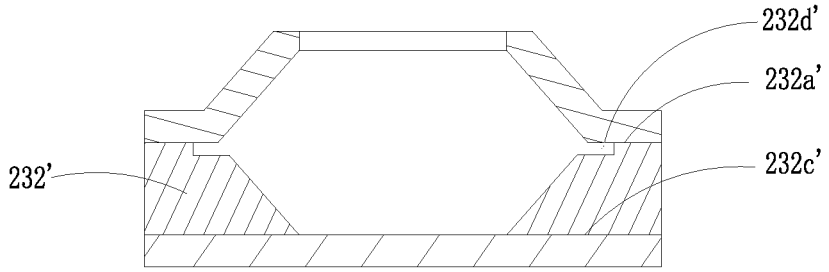
FIG. 6 is a cross-sectional view of a magnetic conductive assembly, and a second magnet of the speaker of a second embodiment.

Referring to FIG. 6, what is different from Embodiment 1 is that the second magnet 232' includes a second fastening slot 232*d'* recessed from the first end surface 232*a'* toward the second end surface 232*c'*, and the suspension 25' is fixed by the second fastening slot 232*d'*.

Embodiment 3

Figure 7:
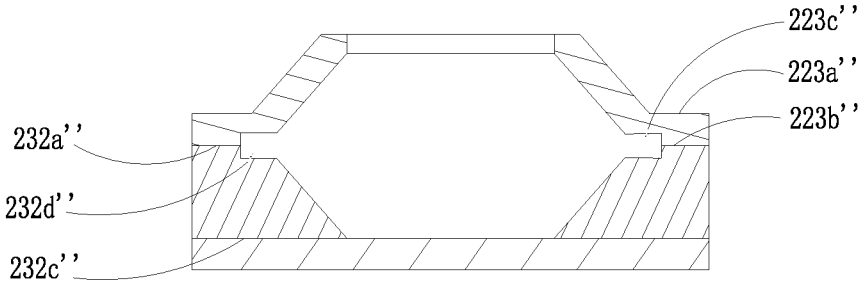
FIG. 7 is a cross-sectional view of a magnetic conductive assembly, and a second magnet of the speaker of a third embodiment.

Referring to FIG. 7, what is different from Embodiment 1 is that the first horizontal portion 223" includes a first fastening slot 223*c"* recessed from the first lower surface 223*b"* toward the first upper surface 223*a"*, and the second magnet 232" includes a second fastening slot 232*d"* recessed from the first end surface 232*a"* toward the second end surface 232*c"*. The suspension 25" is fixed by the first and second fastening slots 223*c"*, 232*d"* cooperatively.

The speaker provided by the present invention includes a magnetic circuit system. The magnetic circuit system includes an upper magnetic conductive plate adjacent to the diaphragm, and a lower magnetic conductive plate far away from the diaphragm. The magnet includes a first magnet mounted on a center of the lower magnetic conductive plate and facing the diaphragm, and a second magnet mounted on the lower magnetic conductive plate and surrounding the first magnet. The upper magnetic conductive plate includes a first horizontal portion engaging with the second magnet, and a first oblique portion extending obliquely from an inner edge of the first horizontal portion toward the diaphragm and at the same time toward the coil assembly. The speaker further includes a suspension sandwiched between the upper magnetic conductive plate and the second magnet for improving the stability of the vibration of the diaphragm and the balance of the vibration, and thus improves the power of speaker.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising:

a vibration system including a diaphragm and a coil assembly for driving the diaphragm to vibrate along a vibration direction;

a suspension for supporting the coil assembly;

a magnetic circuit system including:

a magnetic conductive assembly having a upper conductive plate adjacent to the diaphragm and a lower magnetic conductive plate away from the diaphragm;

a magnet having a first magnet facing the diaphragm and mounted on a center of the lower magnetic conductive plate, and a second magnet mounted on the lower magnetic conductive plate and keeping a distance from the first magnet;

the upper magnetic conductive plate including a first horizontal portion engaging with the second magnet and a first oblique portion extending from an inner edge of the first horizontal toward the diaphragm and at the same time toward the coil assembly;

a receiving space formed by the magnetic conductive assembly and the second magnet for receiving the suspension and the coil assembly therein.

2. The speaker as described in claim 1, wherein the second magnet includes a first end surface adjacent to the first horizontal portion, a second end surface adjacent to the lower magnetic conductive plate, and an inner surface adjacent to the first magnet for connecting the first end surface to the second end surface, the inner surface extends from an inner edge of the first end surface toward the lower magnetic conductive plate and at the same time toward the first magnet, the first end surface connects to the first horizontal portion.

3. The speaker as described in claim 2, wherein the suspension includes a first fastening portion, a second fastening portion, and a connecting portion connecting between the first and second fastening portions, the first fastening portion connects to the coil assembly at an end away from the diaphragm, and the second fastening portion is sandwiched between the first horizontal portion and the second magnet.

4. The speaker as described in claim 3, wherein the first fastening portion of the suspension extends to the second fastening portion along a waved path.

5. The speaker as described in claim 3, wherein the first horizontal portion includes a first lower surface adjacent to the first end surface, a first upper surface opposite to the first lower surface, and a first fastening slot recessed from the first lower surface toward the first upper surface, and/or the second magnet includes a second fastening slot recessed from the first end surface toward the second end surface, and the suspension is fixed by the first fastening slot and/or the second fastening slot.

6. The speaker as described in claim 3, wherein the coil assembly includes a coil frame connected to the diaphragm and a coil wire wound around the coil frame, the coil frame surrounds a part of the first magnet.

7. The speaker as described in claim 6, wherein the first horizontal portion has a projection along a direction perpendicular to the vibration direction at least partially locates on the coil wire.

8. The speaker as described in claim 1, further including a pole plate attached to the first magnet, and the pole plate has a projection along the direction perpendicular to the vibration direction at least partially locates on the first horizontal portion.

* * * * *